US011220977B2

(12) United States Patent
Coppola et al.

(10) Patent No.: US 11,220,977 B2
(45) Date of Patent: Jan. 11, 2022

(54) HIGH-TEMPERATURE, WEAR-RESISTANT COATING FOR A LINERLESS ENGINE BLOCK

(71) Applicant: GM GLOBAL TECHNOLOGY OPERATIONS LLC, Detroit, MI (US)

(72) Inventors: Anthony M. Coppola, Rochester Hills, MI (US); Peter P. Andruskiewicz, IV, Ann Arbor, MI (US); Bradley A. Newcomb, Troy, MI (US); Su Jung Han, West Bloomfield, MI (US); Seongchan Pack, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 169 days.

(21) Appl. No.: 16/539,517

(22) Filed: Aug. 13, 2019

(65) Prior Publication Data

US 2021/0047980 A1 Feb. 18, 2021

(51) Int. Cl.

| | |
|---|---|
| ***F02B 75/08*** | (2006.01) |
| ***F02F 1/00*** | (2006.01) |
| ***B05D 7/22*** | (2006.01) |
| ***B05D 3/12*** | (2006.01) |
| ***B05D 7/00*** | (2006.01) |

(52) U.S. Cl.

CPC ..... *F02F 1/004* (2013.01); *B05D 3/12* (2013.01); *B05D 7/22* (2013.01); *B05D 7/5483* (2013.01); *F02F 2200/00* (2013.01)

(58) Field of Classification Search

CPC ..... F02F 1/004; F02F 2200/00; B05D 3/12; B05D 7/22; B05D 7/5483

USPC ..... 123/668

See application file for complete search history.

(56) References Cited

U.S. PATENT DOCUMENTS

| | | | | |
|---|---|---|---|---|
| 4,848,292 | A * | 7/1989 | Holtzberg | F02F 7/0085 123/193.3 |
| 5,636,821 | A * | 6/1997 | Davies | B65D 73/0021 248/300 |
| 9,644,568 | B2 * | 5/2017 | Maki | F02F 7/0095 |
| 2017/0260926 | A1 * | 9/2017 | Maki | B05D 1/08 |
| 2018/0030922 | A1 | 2/2018 | Kia et al. | |
| 2019/0170082 | A1 | 6/2019 | Coppola et al. | |
| 2019/0170086 | A1 | 6/2019 | Coppola et al. | |

(Continued)

OTHER PUBLICATIONS

Thermalspray Coatings/A&A Coatings, Using A Bonding Layer To Create Thermal Barrier Coatings, Mar. 24, 2018, pp. 1,3 (Year: 2018).*

(Continued)

*Primary Examiner* — Hung Q Nguyen
*Assistant Examiner* — Anthony Donald Taylor, Jr.
(74) *Attorney, Agent, or Firm* — Quinn IP Law

(57) ABSTRACT

A linerless engine block includes a polymer matrix composite having an internal surface that defines a bore. The polymer matrix composite has a first thermal conductivity at the internal surface of at least 5 W/m·° C. The linerless engine block also includes a first bond coating disposed on the internal surface within the bore, and a second wear-resistant coating disposed on the first bond coating within the bore such that the second wear-resistant coating is adhered to the polymer matrix composite by the first bond coating. A method of forming the linerless engine block is also described.

20 Claims, 2 Drawing Sheets

(56) References Cited

U.S. PATENT DOCUMENTS

2020/0131615 A1* 4/2020 Crawmer ..... C23C 4/02
2020/0400093 A1* 12/2020 Elie ..... C23C 4/067

OTHER PUBLICATIONS

Sharp, Bogdanovich, Schuster, Heider; Through-thickness thermal conductivity in composites based on 3-D fiber architectures; SAE Technical Paper Series, Sep. 17-20, 2007;2007-01-3931; ISSN 0148-7191.

He, Ma, Wang, Yong, Chen, Xu; Tribological behaviors of internal plasma sprayed TiO2-based ceramic coating on engine cylinder under lubricated conditions; Tribology International; 102; (2016) 407-418.

Jogur, Khan, Das, Mahajan, Alagirusamy; Impact properties of thermoplastic composites; Textile Progress; 2018, vol. 50, No. 3; 109-183; ISSN: 0040-5167.

Anonymous; Integrated hybrid materials gears; Research Disclosure; Jan. 2019; Research Disclosure database No. 657002; ISSN: 0374-4353.

* cited by examiner

HIGH-TEMPERATURE, WEAR-RESISTANT COATING FOR A LINERLESS ENGINE BLOCK

INTRODUCTION

The disclosure relates to a linerless engine block and to a method of forming the linerless engine block.

Engines, such as internal combustion engines, generally include a metal cylinder block that defines one or more cylindrical bores, and a respective number of metal pistons that slideably translate within the bores during operation of the engine. Such engines are often operated at high temperatures and pressures, and the pistons may reversibly translate within the respective bores at a high speed. The pistons are generally fit to the bores at tight tolerances, and any deviation from tolerance may contribute to metal-to-metal contact between the piston and the bore. Such metal-to-metal contact may damage the bore and/or the piston. For example, the metal piston may scuff, scratch, and/or burnish the cylindrical bore. Damage from metal-to-metal contact may also be exacerbated when the piston and bore are formed from like materials, and/or when the engine is operated at extreme ambient temperatures.

To minimize such metal-to-metal contact between the piston and the comparatively softer metal of the cylinder block, liners or sleeves are often disposed between the piston and the respective bore by casting the cylinder block around the liners or sleeves. The liners or sleeves may be formed from a hard, durable material that does not degrade or become damaged upon contact with the metal of the piston. However, such liners may increase a weight of the engine, contribute to increased material and handling costs, and may complicate cylinder block casting and machining processes.

SUMMARY

A linerless engine block includes a polymer matrix composite having an internal surface that defines a bore. The polymer matrix composite has a first thermal conductivity at the internal surface of at least 5 W/m·° C. The linerless engine block also includes a first bond coating disposed on the internal surface within the bore, and a second wear-resistant coating disposed on the first bond coating within the bore such that the second wear-resistant coating is adhered to the polymer matrix composite by the first bond coating.

In one aspect, the first thermal conductivity may be from 5 W/m·° C. to 15 W/m·° C.

In another aspect, the polymer matrix composite may include a matrix component, a fiber component, a thermally-conductive component, and an additive component. The matrix component may include at least one of an epoxy, a phenolic, a plybismaleimide, a polyimide, a polyamine-imide, a benzoxizine, a polyaryletherketone, a polyetherketone, a polyetherketoneketone, a polyphthalamide, a polyphenylene sulfide, a polyamide, and combinations thereof. The fiber component may include a plurality of fibers formed from at least one of carbon, glass, graphite, boron, basalt, metal, ceramic, and combinations thereof. The additive component may include at least one of ceramic particles, graphene, nanotubes, nanoparticles, metallic particles, and combinations thereof. The thermally-conductive component may include fibers arranged in a radial direction, graphene, z-pins, nanoparticles, and combinations thereof.

In a further aspect, the first bond coating may be formed from at least one of zinc, aluminum, selenium, copper, nickel, and alloys thereof.

In yet another aspect, the second wear-resistant coating may be formed from a ceramic or a metal. The second wear-resistant coating may be formed from at least one of titanium dioxide, zirconia, yttria-stabilized zirconia, aluminum oxide, spinels, perovskites, carbides, steel, bronze alloys, aluminum-silicon alloys, nickel alloys, and combinations thereof.

In an additional aspect, the second wear-resistant coating may have a porous microstructure defining a plurality of pores therein.

In one aspect, the polymer matrix composite may have a first thickness of from 1 mm to 10 mm at the bore.

In another aspect, the polymer matrix composite may further define a plurality of bores spaced apart from one another by a first distance that is less than two times the first thickness.

In a further aspect, the first bond coating may have a second thickness of from 0.01 mm to 0.2 mm and a second thermal conductivity of from 50 W/m·° C. to 400 W/m·° C.

In yet another aspect, the second wear-resistant coating may have a third thickness of from 0.1 mm to 1 mm and a third thermal conductivity of from 0.5 W/m·° C. to 3 W/m·° C.

In an additional aspect, the polymer matrix composite may not be formed from any of aluminum and iron.

In one aspect, the linerless engine block may be free from a liner formed from iron and disposed within the bore.

A method of forming a linerless engine block includes forming a polymer matrix composite having an internal surface that defines a bore. The polymer matrix composite has a first thermal conductivity at the internal surface of at least 5 W/m·° C. The method also includes depositing a first bond coating on the internal surface within the bore, and depositing a second wear-resistant coating on the first bond coating within the bore such that the second wear-resistant coating is adhered to the polymer matrix composite by the first bond coating. The method further includes machining the second wear-resistant coating to thereby form the linerless engine block.

In one aspect, forming the polymer matrix composite may include at least one of pultrusion, braiding, filament winding, resin transfer molding, and combinations thereof.

In another aspect, depositing the first bond coating may include applying the first bond coating by at least one of twin wire arc deposition, high velocity oxy fuel deposition, cold spraying, kinetic spraying, plating, and combinations thereof.

In a further aspect, depositing the second wear-resistant coating may include applying the second wear-resistant coating by at least one of twin wire arc deposition, rotation single wire deposition, plasma transferred wire arc deposition, air plasma spraying, high velocity oxy fuel deposition, plating, and combinations thereof.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
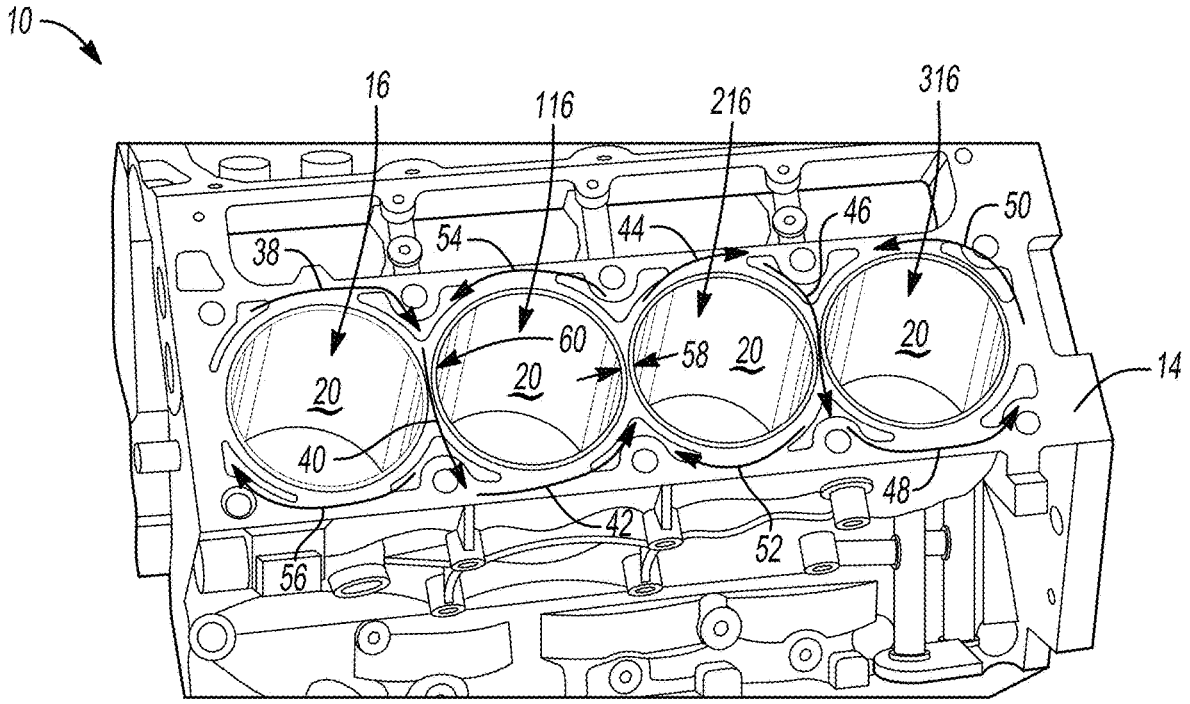
FIG. 1 is a schematic illustration of a perspective view of a linerless engine block.

Referring to the Figures, wherein like reference numerals refer to like elements, a linerless engine block is shown generally at 10 in FIG. 1. The linerless engine block 10 may provide power to a device or system. As a non-limiting example, the linerless engine block 10 may be a gasoline- or diesel-fueled internal combustion engine. Therefore, the linerless engine block 10 may be useful for automotive applications. However, based upon the excellent wear- and temperature-resistance of the linerless engine block 10, the linerless engine block 10 may also be useful for non-automotive applications, such as, but not limited to, aviation, rail, marine, stationary power generator, and recreational vehicle applications.

Figure 2:
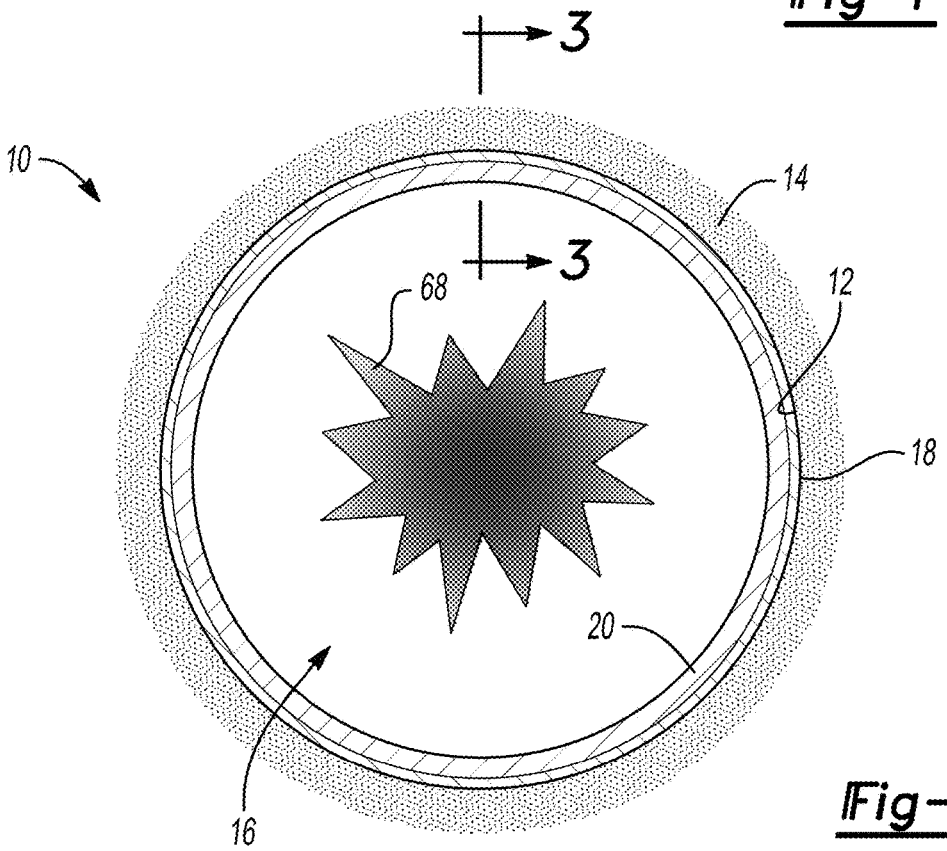
FIG. 2 is a schematic illustration of a top view of a bore defined by an internal surface of the linerless engine block of FIG. 1, wherein a first bond coating is disposed on the internal surface and a second wear-resistant coating is disposed on the first bond coating.
Figure 3:
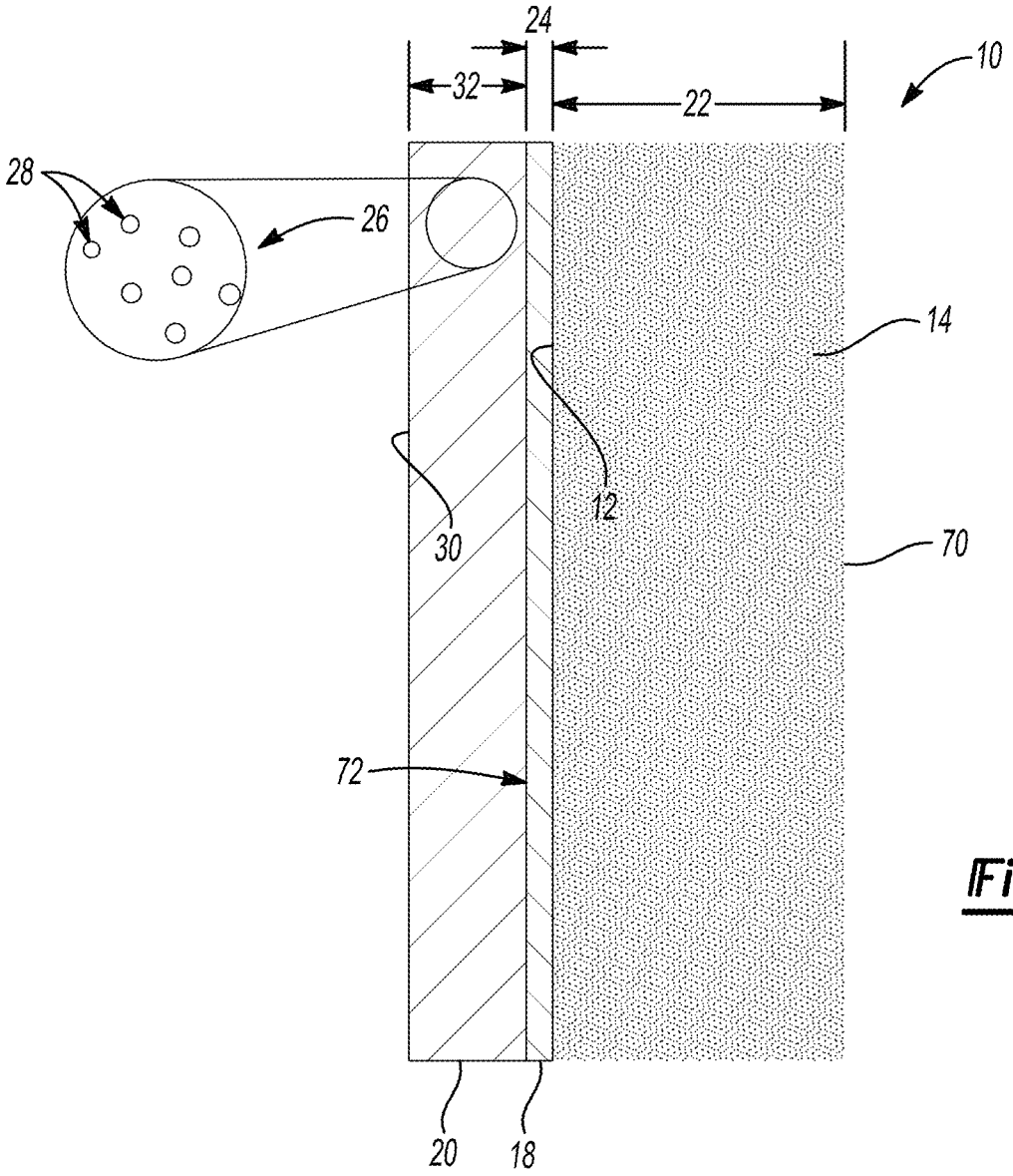
FIG. 3 is a schematic illustration of a cross-sectional view of the linerless engine block of FIG. 2 at the bore taken along section lines 3-3.

Referring now to FIG. 2, the linerless engine block 10 includes an internal surface 12 defining a bore 16. The internal surface 12 may be a portion of a cylinder block of the linerless engine block 10 and may be cast and/or machined to define the bore 16. Further, to minimize a weight of the linerless engine block 10, the linerless engine block 10 and internal surface 12 may be formed from a polymer matrix composite 14 rather than, for example, a castable aluminum-silicon alloy or a castable iron, as set forth in more detail below. As used herein, the terminology "linerless" refers to an engine that is substantially free from a liner or sleeve disposed in contact with the bore 16. That is, the linerless engine block 10 does not require or include the liner or sleeve within the bore 16 for protection of the bore 16 during operation of the linerless engine block 10. In other words, the linerless engine block 10 may be free from the liner formed from, for example, iron and disposed within the bore 16. Instead, as set forth in more detail below, the linerless engine block 10 may be lightweight and have excellent wear- and temperature-resistance due to a first bond coating 18 (FIGS. 2 and 3) disposed on the internal surface 12 and a second wear-resistant coating 20 (FIGS. 2 and 3) disposed on the first bond coating 18 within the bore 16. Further, the linerless engine block 10 may reduce mass, noise, and heat-up time of an engine.

Referring again to FIG. 1, in one variation, the polymer matrix composite 14 may define a plurality of bores 16, 116, 216, 316. By way of non-limiting examples, the linerless engine block 10 may define a plurality of bores 16, 116, 216, 316 so that the linerless engine block 10 may be configured as a 2-cylinder, 3-cylinder, 4-cylinder, 5-cylinder, 6-cylinder, 8-cylinder, 10-cylinder, 12-cylinder, or 16-cylinder linerless engine block 10. Further, although the plurality of bores 16, 116, 216, 316 is shown in a "V" configuration in FIG. 1, i.e., in a V-8 configuration, so that four bores 16, 116, 216, 316 of one branch of the "V" are visible, the plurality of bores 16, 116, 216, 316 may also be arranged in series to form an in-line linerless engine block 10 or other multi-cylinder linerless engine, such as, but not limited to, a linerless engine block 10 having a "W" configuration, a linerless engine block 10 having an opposed "boxer" configuration, or a linerless engine block 10 having a radial configuration. Further, as set forth above, the linerless engine block 10 may be a single-cylinder linerless engine block 10. Therefore, the linerless engine block 10 may be suitable for any application requiring wear- and temperature-resistance of the bores 16, 116, 216, 316, especially when the linerless engine block 10 is operated at high temperatures under load, i.e., at high temperatures during full power output. As used herein, the terminology "high load" refers to an operating condition of the linerless engine block 10 including high temperatures, e.g., from 100° C. to 1,000° C., and high loads or high speeds, e.g., greater than about 5,000 revolutions per minute (rpm). During such operating conditions, the linerless engine block 10 may experience reduced lubrication from an oil or reduced cooling from a coolant.

Referring again to FIG. 2, the linerless engine block 10 includes the polymer matrix composite 14 having the internal surface 12 defining the bore 16. That is, the polymer matrix composite 14 forms the main structure of the linerless engine block 10 and provides structural support for the engine. More specifically, the polymer matrix composite 14 may include a matrix component, a fiber component, and an additive component. That is, the fiber component and the additive component may be dispersed within the matrix component to provide the polymer matrix composite with strength and rigidity, and to ensure the polymer matrix composite is lightweight. As such, the polymer matrix composite 14 may not be formed from any of aluminum and iron. The linerless engine block 10 is therefore lightweight, transmits a comparatively small amount of noise during operation, and is comparatively quick to heat up to operating temperature.

The matrix component may include at least one of an epoxy, a phenolic, a polybismaleimide, a polyimide, a polyamide-imide, a benzoxizine, a polyaryletherketone, a polyetheretherketone, a polyetherketoneketone, a polyphthalamide, a polyphenylene sulfide, a polyamide, and combinations thereof. The fiber component may include a plurality of fibers formed from at least one of carbon, glass, graphite, boron, basalt, metal, ceramic, and combinations thereof. Further, the additive component may include at least one of ceramic particles, graphene, nanotubes, nanoparticles, metallic particles, and combinations thereof. The thermally-conductive component may include fibers arranged in a radial direction, graphene, z-pins, nanoparticles, and combinations thereof.

The polymer matrix composite 14 may have a first thickness 22 (FIG. 3) of from 1 mm to 10 mm at the bore 16, e.g., from 2 mm to 8 mm, or from 2 mm to 5 mm, or from 3 mm to 4 mm. In addition, the polymer matrix composite 14 has a first thermal conductivity at the internal surface 12 of at least 5 W/m·° C. That is, the first thermal conductivity may be measured in a radial or through-thickness direction extending outward from a center of the bore 16. For example, the first thermal conductivity may be from 5 W/m·° C. to 15 W/m·° C. In one embodiment, the first thermal conductivity may be 10 W/m·° C. Stated differently, the polymer matrix composite 14 may have a comparatively high thermal conductivity, i.e., higher than a comparative thermal conductivity of from 0.6 W/m·° C. to 1 W/m·° C. for, for example, a carbon fiber—epoxy composite.

To achieve this excellent first thermal conductivity, the fiber component or the thermally-conductive component may be selected to have a high radial thermal conductivity, such as fibers commercially available under the tradenames P100 from 3M of Maplewood, Minn. and K1100 from Hexcel® of Stamford, Conn. Alternatively or additionally, the fiber component or the thermally-conductive component may include from 5 parts by volume to 10 parts by volume based on 100 parts by volume of the fibers arranged in a radial direction. As another example, the thermally-conductive component may include z-pins having high thermal conductivity that may be inserted into the polymer matrix composite 14. Further, the thermally-conductive component may include high thermally-conductive additives such as graphene or nano-metallic powders.

Referring again to FIGS. 2 and 3, the linerless engine block 10 also includes the first bond coating 18 disposed on the internal surface 12 within the bore 16. The first bond coating 18 may be a metallic bond coating and may be formed from, for example, at least one of zinc, aluminum, selenium, copper, nickel, and alloys thereof.

The first bond coating 18 may also have a comparatively high thermal conductivity. In particular, the first bond coating 18 may have a second thickness 24 of from 0.01 mm to 0.2 mm and a second thermal conductivity of from 50 W/m·° C. to 400 W/m·° C. For example, the second thickness 24 may be from 0.03 mm to 0.1 mm or from 0.05 mm to 0.075 mm. Further, the second thermal conductivity may be from 100 W/m·° C. to 350 W/m·° C. or from 150 W/m·° C. to 300 W/m·° C. or from 200 W/m·° C. to 250 W/m·° C. Further, the first bond coating 18 may have a comparatively dense microstructure. As such, the first bond coating 18 may increase a thermal conductivity of the bore 16.

Referring again to FIGS. 2 and 3, the linerless engine block 10 also includes the second wear-resistant coating 20 disposed on the first bond coating within the bore 16 such that the second wear-resistant coating 20 is adhered to the polymer matrix composite 14 by the first bond coating 18. That is, the first bond coating 18 may bond or attach the second wear-resistant coating 20 to the polymer matrix composite 14.

The second wear-resistant coating 20 may be formed from a ceramic or a metal to provide the second wear-resistant coating 20 and the linerless engine block 10 with excellent scuff-resistance, durability, and strength within the bore 16. For example, the second wear-resistant coating 20 may be formed from at least one of titanium dioxide, zirconia, yttria-stabilized zirconia, aluminum oxide, spinels, perovskites, carbides, steel, bronze alloys, aluminum-silicon alloys, nickel alloys, and combinations thereof. In one embodiment, the second wear-resistant coating 20 may be formed from steel or a ceramic oxide and may be thermally sprayed onto the internal surface 12. As such, the first bond coating 18 may bond two dissimilar materials to increase adhesion between the polymer matrix composite 14 and the ceramic or metal of the second wear-resistant coating 20 without damaging the polymer matrix composite 14.

Further, the second wear-resistant coating 20 may have a porous microstructure (illustrated generally at 26 in FIG. 3) defining a plurality of pores 28 therein. That is, the plurality of pores 28 may be defined by a surface 30 of the second wear-resistant coating 20 such that the second wear-resistant coating 20 has a surface porosity of from 0.1% to 10%. Stated differently, the plurality of pores 28 may be present in the surface 30 in an amount of 0.1 part by volume to 10 parts by volume based on 100 parts by volume of the surface 30. Such porous microstructure 26 may provide the linerless engine block 10 with excellent lubrication. That is, the plurality of pores 28 may provide pockets to entrap a lubricant (not shown) such that the second wear-resistant coating 20 has a comparatively high wear-resistance and a comparatively low frictional resistance.

The second wear-resistant coating 20 may also have a comparatively high thermal conductivity. In particular, the second wear-resistant coating 20 may have a third thickness 32 of from 0.1 mm to 1 mm and a third thermal conductivity of from 0.5 W/m·° C. to 3 W/m·° C. For example, the third thickness 32 may be from 0.3 mm to 0.7 mm, or 0.5 mm. Further, the third thermal conductivity may be from 1 W/m·° C. to 2.5 W/m·° C., or from 1.5 W/m·° C. to 2 W/m·° C., or 1.75 W/m·° C.

In combination, the polymer matrix composite 14, first bond coating 18, and second wear-resistant coating 20 may provide the linerless engine block 10 with excellent temperature- and wear-resistance. Further, each respective thickness 22, 24, 32 and thermal conductivity of the polymer matrix composite 14, first bond coating 18, and second wear-resistant coating 20 may be selected, tuned, or tailored to specific operating conditions of the linerless engine block 10. For example, during operation of the linerless engine block 10, although a combustion temperature can reach 2,500° C. or more for a mere instant, an average combustion gas temperature (denoted generally at 68 in FIG. 2) during operation may be from 500° C. to 1,000° C. or about 700° C. However, at an edge 70 (FIG. 3) spaced away from the bore 16, the operating temperature may decrease to from 140° C. to 165° C., e.g., about 160° C. Further, the operating temperature at the surface 30 of the second wear-resistant coating 20 may be from about 260° C. to about 280° C., e.g., about 270° C. Most oils and lubricants may break down and lose lubrication properties at from 250° C. to 300° C. Consequently, the linerless engine block 10 has the thermal conductivities that maintain the operating temperature below these values. That is, based on the excellent third thermal conductivity, the operating temperature at an interface 72 (FIG. 3) between the second wear-resistant coating 20 and the first bond coating 18 may be from 220° C. to 230° C. Similarly, based on the comparatively high second thermal conductivity of the first bond coating 18, the operating temperature at the internal surface 12 may be lower than the operating temperature at the interface 72, e.g., from about 225° C. to about 230° C. As such, the linerless engine block 10 may be free from a liner (not shown) formed from iron and disposed within the bore 16. That is, the second wear-resistant coating 20, adhered to the polymer matrix composite 14 by the first bond coating 18, may replace the liner but may still provide the linerless engine block 10 with suitable temperature- and wear-resistance without adding excess weight to the linerless engine block 10.

Figure 4:
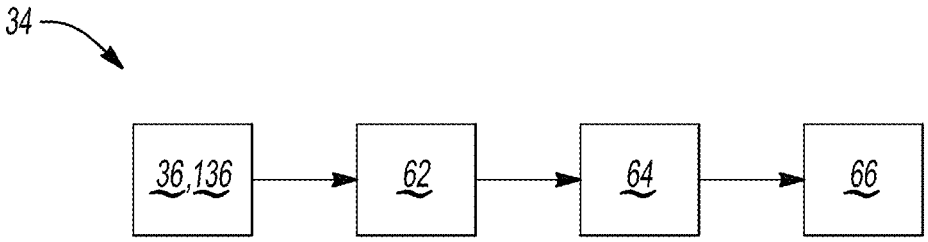
FIG. 4 is a flowchart of a method of forming the linerless engine block of FIG. 1.

Referring now to FIG. 4, a method 34 of forming the linerless engine block 10 includes forming 36 the polymer matrix composite 14 having the internal surface 12 that defines the bore 16. As set forth above, the polymer matrix composite 14 has the first thermal conductivity at the internal surface 12 of at least 5 W/m·° C.

In greater detail, forming 36 the polymer matrix composite 14 may include at least one of pultrusion, braiding 136, filament winding, resin transfer molding, and combinations thereof. For example, the polymer matrix composite 14 may be formed via a process that ensures the comparatively high first thermal conductivity of at least 5 W/m·° C. That is, the polymer matrix composite 14 may be formed by a process that prevents damage to the polymer matrix composite 14 and allows for comparatively fast quenching and heat release that may minimize residual stress and delamination of the first bond coating 18 and the second wear-resistant coating 20 on the internal surface 12 at the bore 16.

Although dependent upon the desired application of the linerless engine block 10, the polymer matrix composite 14 may be formed by a suitable process that includes solidifying the matrix component, the fiber component, and the additive component from a fluid state to a solid state. Further, the formation process may include heat treatment to enhance mechanical properties of the polymer matrix composite 14. After the polymer matrix composite 14 is formed to define the bore 16 or bores 116, 216, 316, the polymer matrix composite 14 may also be washed, machined, and/or finished. For example, the polymer matrix composite 14 may be washed to minimize debris present in the bore 16 to prevent scuffing and/or wear of components of the linerless engine block 10 during operation.

In one non-limiting embodiment described with reference to FIG. 1, the polymer matrix composite 14 may be formed by braiding 136 or weaving the polymer matrix composite 14 in a pattern or direction (denoted generally at arrows 38-56) to form the linerless engine block 10 having seamless bores 16, 116, 216, 316. Braiding 136 may be particularly useful for linerless engines 10 that define the plurality of bores 16, 116, 216, 316 disposed adjacent one another in the engine block. That is, as shown in FIG. 1, the polymer matrix composite 14 may define the plurality of bores 16, 116, 216, 316 spaced apart from one another by a first distance 58 that is less than two times the first thickness 22. In other, braiding 136 may allow for a shared wall (denoted generally at 60) between two bores 16 to be thinner than two times the first thickness 22. As such, braiding 136 may allow for multiple bores 16 that share intertangled fibers of the fiber component of the polymer matrix composite 14. Therefore, such braiding 136 may allow for comparatively closer spacing between adjacent bores 16 and therefore, lower mass of the linerless engine block 10.

Referring again to FIG. 4, the method 34 also includes depositing 62 the first bond coating 18 on the internal surface 12 within the bore 16. For example, depositing 62 the first bond coating 18 may include applying the first bond coating 18 by at least one of twin wire arc deposition, high velocity oxy fuel deposition, cold spraying, kinetic spraying, plating, and combinations thereof.

Referring again to FIG. 4, the method 34 also includes depositing 64 the second wear-resistant coating 20 on the first bond coating 18 within the bore 16 such that the second wear-resistant coating 20 is adhered to the polymer matrix composite 14 by the first bond coating 18. For example, depositing 64 the second wear-resistant coating 20 may include applying the second wear-resistant coating by at least one of twin wire arc deposition, rotation single wire deposition, plasma transferred wire arc deposition, air plasma spraying, high velocity oxy fuel deposition, plating, and combinations thereof.

The method 34 also includes machining 66 the second wear-resistant coating 20 to thereby form the linerless engine block 10. That is, machining 66 may include shaping the second wear-resistant coating 20 to required tolerances, e.g., to match a diameter of a piston that is slideably disposable within the bore 16. Machining 66 may include shaping the second wear-resistant coating 20 by, for example, cutting, grinding, honing, polishing, and combinations thereof.

Therefore, the linerless engine block 10 and method 34 may be useful for applications requiring lightweight, linerless engine blocks 10 that are suitable for high-temperature and high-wear operating environments. Further, the linerless engine block 10 may reduce noise and heat-up time for an engine. In particular, the second wear-resistant coating 20 provides the linerless engine block 10 with excellent temperature- and wear-resistance and the first bond coating 18 ensures an excellent bond between the polymer matrix composite 14 and the second wear-resistant coating 20, even though the polymer matrix composite 14 and the second wear-resistant coating 20 are formed from dissimilar materials. Further, since the polymer matrix composite 14 is lightweight compared to a castable metal alloy such as aluminum or iron, and since the first bond coating 18 and the second wear-resistant coating 20 eliminate the need for a liner disposed within the bore 16, the linerless engine block 10 is also lightweight. Therefore, the linerless engine block 10 and method 34 are cost-effective.

While the best modes for carrying out the disclosure have been described in detail, those familiar with the art to which this disclosure relates will recognize various alternative designs and embodiments for practicing the disclosure within the scope of the appended claims.

What is claimed is:

1. A linerless engine block comprising:

a polymer matrix composite having an internal surface that defines a bore, wherein the polymer matrix composite forms a main structure of the linerless engine block and provides structural support for the linerless engine block, the polymer matrix composite having and has a first thermal conductivity at the internal surface of at least 5 W/m*° C.;

a first bond coating disposed on the internal surface within the bore; and a second wear-resistant coating disposed on the first bond coating within the bore such that the second wear-resistant coating is adhered to the polymer matrix composite by the first bond coating.

2. The linerless engine block of claim 1, wherein the first thermal conductivity is from 5 W/m·° C. to 15 W/m·° C.

3. The linerless engine block of claim 1, wherein the polymer matrix composite includes a matrix component, a fiber component, a thermally-conductive component, and an additive component.

4. The linerless engine block of claim 3, wherein the matrix component includes at least one of an epoxy, a phenolic, a polybismaleimide, a polyimide, a polyamide-imide, a benzoxizine, a polyaryletherketone, a polyetheretherketone, a polyetherketoneketone, a polyphthalamide, a polyphenylene sulfide, a polyamide, and combinations thereof.

5. The linerless engine block of claim 3, wherein the fiber component includes a plurality of fibers formed from at least one of carbon, glass, graphite, boron, basalt, metal, ceramic, and combinations thereof.

6. The linerless engine block of claim 3, wherein the additive component includes at least one of ceramic particles, graphene, nanotubes, nanoparticles, metallic particles, and combnations thereof; and wherein the thermally-conductive component includes graphene, z-pins, nanoparticles, and combinations thereof.

7. The linerless engine block of claim 1, wherein the first bond coating is formed from at least one of zinc, aluminum, selenium, copper, nickel, and alloys thereof.

8. The linerless engine block of claim 1, wherein the second wear-resistant coating is formed from a ceramic or a metal.

9. The linerless engine block of claim 8, wherein the second wear-resistant coating is formed from at least one of titanium dioxide, zirconia, yttria-stabilized zirconia, aluminum oxide, spinels, perovskites, carbides, steel, bronze alloys, aluminum-silicon alloys, nickel alloys, and combinations thereof.

10. The linerless engine block of claim 1, wherein the second wear-resistant coating has a porous microstructure defining a plurality of pores therein.

11. The linerless engine block of claim 1, wherein the polymer matrix composite has a first thickness of from 1 mm to 10 mm at the bore.

12. The linerless engine block of claim 11, wherein the polymer matrix composite further defines a plurality of bores spaced apart from one another by a first distance that is less than two times the first thickness.

13. The linerless engine block of claim 12, wherein the first bond coating has a second thickness of from 0.01 mm to 0.2 mm and a second thermal conductivity of from 50 W/m·° C. to 400 W/m·° C.

14. The linerless engine block of claim 13, wherein the second wear-resistant coating has a third thickness of from 0.1 mm to 1 mm and a third thermal conductivity of from 0.5 W/m·° C. to 3 W/m·° C.

15. The linerless engine block of claim 1, wherein the polymer matrix composite is not formed from any of aluminum and iron.

16. The linerless engine block of claim 1, wherein the linerless engine block is free from a liner formed from iron.

17. A method of forming a linerless engine block, the method comprising:

forming a polymer matrix composite having an internal surface that defines a bore, wherein the polymer matrix composite forms a main structure of the linerless engine block and provides structural support for the linerless engine block, the polymer matrix composite having a first thermal conductivity at the internal surface of at least 5 W/m*° C.;

depositing a first bond coating on the internal surface within the bore;

depositing a second wear-resistant coating on the first bond coating within the bore such that the second wear-resistant coating is adhered to the polymer matrix composite by the first bond coating; and machining the second wear-resistant coating to thereby form the linerless engine block.

18. The method of claim 17, wherein forming the polymer matrix composite includes at least one of pultrusion, braiding, filament winding, resin transfer molding, and combinations thereof.

19. The method of claim 17, wherein depositing the first bond coating includes applying the first bond coating by at least one of twin wire arc deposition, high velocity oxy fuel deposition, cold spraying, kinetic spraying, plating, and combinations thereof.

20. The method of claim 17, wherein depositing the second wear-resistant coating includes applying the second wear-resistant coating by at least one of twin wire arc deposition, rotation single wire deposition, plasma transferred wire arc deposition, air plasma spraying, high velocity oxy fuel deposition, plating, and combinations thereof.

* * * * *